US010019872B2

(12) United States Patent
Sherrets et al.

(10) Patent No.: US 10,019,872 B2
(45) Date of Patent: Jul. 10, 2018

(54) GAMING MACHINE AND SYSTEM FOR REDEEMING AN ACCRUED ATTRIBUTE IN SUBSEQUENT GAMING INSTANCES

(71) Applicant: BALLY GAMING, INC., Las Vegas, NV (US)

(72) Inventors: Nathan D. Sherrets, Cedar Rapids, IA (US); Bryan J. Vandaele, Cedar Falls, IA (US); Aaron J. Schurman, Cedar Falls, IA (US)

(73) Assignee: Bally Gaming, Inc., Las Vegas, NV (US)

( * ) Notice: Subject to any disclaimer, the term of this patent is extended or adjusted under 35 U.S.C. 154(b) by 250 days.

(21) Appl. No.: 14/807,110

(22) Filed: Jul. 23, 2015

(65) Prior Publication Data

US 2017/0024970 A1 Jan. 26, 2017

(51) Int. Cl.
*A63F 9/00* (2006.01)
*G07F 17/32* (2006.01)

(52) U.S. Cl.
CPC ..... *G07F 17/3267* (2013.01); *G07F 17/3244* (2013.01)

(58) Field of Classification Search
None
See application file for complete search history.

(56) References Cited

U.S. PATENT DOCUMENTS

| | | | | |
|---|---|---|---|---|
| 4,837,728 | A | 6/1989 | Barrie et al. | 463/27 |
| 6,347,996 | B1 | 2/2002 | Gilmore et al. | 463/17 |
| 6,632,141 | B2 | 10/2003 | Webb et al. | 463/25 |
| 6,837,788 | B2 | 1/2005 | Cannon | 463/16 |
| 6,843,722 | B2 | 1/2005 | Webb | 463/16 |
| 6,875,108 | B1 | 4/2005 | Hughs Baird | 463/26 |
| 6,984,174 | B2 | 1/2006 | Cannon et al. | 463/25 |
| 7,014,560 | B2 | 3/2006 | Glavich et al. | 463/20 |
| 7,235,011 | B2 * | 6/2007 | Randall | G07F 17/32 463/25 |
| 7,303,469 | B2 | 12/2007 | Kaminkow | 463/20 |
| 7,314,410 | B2 | 1/2008 | Baerlocher et al. | 463/16 |

(Continued)

FOREIGN PATENT DOCUMENTS

| | | | |
|---|---|---|---|
| WO | WO2005099368 A2 | 10/2005 | G06Q 20/18 |
| WO | WO2007030670 A2 | 3/2007 | G07F 17/3244 |
| WO | WO2015042440 A1 | 3/2015 | G07F 17/322 |

*Primary Examiner* — Seng H Lim

(74) *Attorney, Agent, or Firm* — David J. Bremer

(57) ABSTRACT

A gaming system includes a gaming machine for redeeming an accrued attribute in subsequent plays of a wagering game. A wagering game instance may include a randomly triggered bonus game. One or more occurrences, events, or conditions are accrued in a tally during the bonus game. The tally grants an attribute for redemption in one or more subsequent randomly generated outcomes (e.g., subsequent plays of the wagering game, spins of the bonus game, etc.). The occurrences, events, or conditions may include any quantifiable measurement, including a number of winning, losing, or performed spins of the bonus game, appearance of specific symbols, wins over a threshold amount, etc. The resulting attribute(s) diminish over time and may include a win amount multiplier, a number of added symbols to one or more reels, a modified math model for a predetermined number of spins, additional game features or eligibility, etc.

20 Claims, 7 Drawing Sheets

(56) References Cited

U.S. PATENT DOCUMENTS

| | | | | |
|---|---|---|---|---|
| 7,338,367 | B2 | 3/2008 | Kaminkow et al. | 463/16 |
| 7,364,507 | B2 | 4/2008 | Baerlocher et al. | 463/25 |
| 7,413,508 | B2 | 8/2008 | Nelson et al. | 463/11 |
| 7,455,585 | B2 | 11/2008 | Englman | 463/16 |
| 7,470,186 | B2 | 12/2008 | Cannon | 463/18 |
| 7,530,893 | B2 | 5/2009 | Thomas | 463/20 |
| 7,654,897 | B2 | 2/2010 | Devaull et al. | 463/20 |
| 7,666,083 | B2 | 2/2010 | Baerlocher et al. | 463/18 |
| 7,690,982 | B2 | 4/2010 | Cuddy | 463/20 |
| 7,704,137 | B2 | 4/2010 | Englman | 463/16 |
| 7,713,119 | B2 | 5/2010 | Pacey et al. | 463/20 |
| 7,713,122 | B2 | 5/2010 | Pacey | 463/25 |
| 7,753,784 | B2 | 7/2010 | Baerlocher | 463/28 |
| 7,758,410 | B2 | 7/2010 | Hughes | 463/13 |
| 7,789,747 | B2 | 9/2010 | Glavich et al. | 463/17 |
| 7,798,899 | B2 | 9/2010 | Acres | 463/29 |
| 7,819,743 | B2 | 10/2010 | Olivas et al. | 463/25 |
| 7,819,746 | B2 | 10/2010 | Schneider et al. | 463/29 |
| 7,828,649 | B2 | 11/2010 | Cuddy et al. | 463/26 |
| 7,841,936 | B2 | 11/2010 | Berman et al. | 463/20 |
| 7,857,699 | B2 | 12/2010 | Baerlocher | 463/27 |
| 7,862,420 | B2 | 1/2011 | Peterson | 463/20 |
| 7,883,406 | B2 | 2/2011 | Vancura | 463/20 |
| 8,002,619 | B2 | 8/2011 | Gagner et al. | 463/12 |
| 8,096,866 | B2 | 1/2012 | Kamano | 463/16 |
| 8,096,873 | B2 | 1/2012 | Walker et al. | 463/25 |
| 8,118,666 | B2 | 2/2012 | Nicely et al. | 463/25 |
| 8,123,610 | B2 | 2/2012 | Hornik | 463/20 |
| 8,137,181 | B2 | 3/2012 | Bleich et al. | 463/20 |
| 8,142,274 | B2 | 3/2012 | Baerlocher | 463/20 |
| 8,172,668 | B2 | 5/2012 | Gomez | 463/20 |
| 8,210,932 | B2 | 7/2012 | Shiraishi | 463/25 |
| 8,210,942 | B2 | 7/2012 | Shimabukuro et al. | 463/30 |
| 8,231,456 | B2 | 7/2012 | Zielinski | 463/25 |
| 8,246,445 | B2 | 8/2012 | Rodgers et al. | 463/21 |
| 8,308,556 | B2 | 11/2012 | Thomas | 463/25 |
| 8,317,587 | B2 | 11/2012 | Gomez et al. | 463/16 |
| 8,342,945 | B2 | 1/2013 | Gomez | 463/25 |
| 8,444,474 | B2 | 5/2013 | Jaffe et al. | 463/20 |
| 8,480,473 | B2 | 7/2013 | Villejo et al. | 463/18 |
| 8,480,475 | B2 | 7/2013 | Adiraju et al. | 463/20 |
| 8,480,480 | B2 | 7/2013 | Thomas et al. | 463/20 |
| 8,523,647 | B2 | 9/2013 | McClintic | 463/9 |
| 8,550,897 | B2 | 10/2013 | Hornik et al. | 463/20 |
| 8,574,053 | B1 | 11/2013 | Nelson et al. | 463/16 |
| 8,585,489 | B2 | 11/2013 | Cannon | 463/25 |
| 8,602,883 | B2 | 12/2013 | Cuddy et al. | 463/27 |
| 8,608,556 | B2 | 12/2013 | Olive | 463/26 |
| 8,628,405 | B2 | 1/2014 | Gelber et al. | 463/25 |
| 8,641,509 | B2 | 2/2014 | Nicely | 463/20 |
| 8,641,520 | B2 | 2/2014 | Vann | 463/27 |
| 8,651,947 | B2 | 2/2014 | Caputo et al. | 463/25 |
| 8,663,002 | B2 | 3/2014 | Oosthoek | 463/27 |
| 8,668,567 | B2 | 3/2014 | Belger et al. | 463/16 |
| 8,690,658 | B2 | 4/2014 | Pacey et al. | 463/20 |
| 8,747,205 | B2 | 6/2014 | Englman | 463/16 |
| 8,764,537 | B2 | 7/2014 | Jaffe et al. | 463/16 |
| 8,795,048 | B2 | 8/2014 | Schaefer et al. | 463/10 |
| 8,795,058 | B2 | 8/2014 | Wolf et al. | 463/21 |
| 8,864,574 | B2 | 10/2014 | Naglestad Cohen | 463/25 |
| 8,870,645 | B2 | 10/2014 | Baerlocher et al. | 463/25 |
| 8,870,647 | B2 | 10/2014 | Huizinga | 463/29 |
| 8,926,426 | B2 | 1/2015 | Frerking | 463/29 |
| 8,974,293 | B2 | 3/2015 | Luciano | 463/25 |
| 8,979,645 | B2 | 3/2015 | Baerlocher et al. | 463/25 |
| 8,998,703 | B2 | 4/2015 | Baerlocher | 463/20 |
| 9,011,251 | B2 | 4/2015 | Aoki et al. | 463/42 |
| 2003/0162585 | A1* | 8/2003 | Bigelow, Jr. | G07F 17/32 463/20 |
| 2004/0038731 | A1* | 2/2004 | Englman | G07F 17/32 463/25 |
| 2004/0053672 | A1* | 3/2004 | Baerlocher | G07F 17/34 463/20 |
| 2004/0147306 | A1* | 7/2004 | Randall | G07F 17/32 463/20 |
| 2007/0259706 | A1 | 11/2007 | Anderson et al. | 463/16 |
| 2008/0108431 | A1 | 5/2008 | Cuddy et al. | 463/27 |
| 2008/0153600 | A1 | 6/2008 | Swarna | 463/43 |
| 2008/0200244 | A1 | 8/2008 | Rowe et al. | 463/27 |
| 2008/0293478 | A1 | 11/2008 | Anderson et al. | 463/25 |
| 2009/0124362 | A1 | 5/2009 | Cuddy et al. | 463/27 |
| 2010/0075747 | A1 | 3/2010 | Hein | 463/29 |
| 2011/0045898 | A1* | 2/2011 | Anderson | G07F 17/32 463/25 |
| 2011/0117992 | A1 | 5/2011 | Nelson et al. | 463/20 |
| 2011/0118000 | A1* | 5/2011 | Jaffe | G07F 17/32 463/20 |
| 2011/0207526 | A1 | 8/2011 | Kamano | 463/26 |
| 2011/0230251 | A1 | 9/2011 | Nicely et al. | 463/20 |
| 2011/0263317 | A1 | 10/2011 | Marks et al. | 463/20 |
| 2012/0270633 | A1* | 10/2012 | Jackson | G07F 17/34 463/20 |
| 2012/0295688 | A1* | 11/2012 | Watkins | G07F 17/3211 463/20 |
| 2013/0079114 | A1* | 3/2013 | Nicely | G07F 17/3239 463/25 |
| 2013/0090156 | A1 | 4/2013 | Oh et al. | 463/25 |
| 2013/0296010 | A1* | 11/2013 | Berman | G07F 17/3267 463/13 |
| 2013/0310127 | A1* | 11/2013 | Berman | G07F 17/3267 463/13 |
| 2015/0080118 | A1 | 3/2015 | Harris et al. | 463/27 |

* cited by examiner

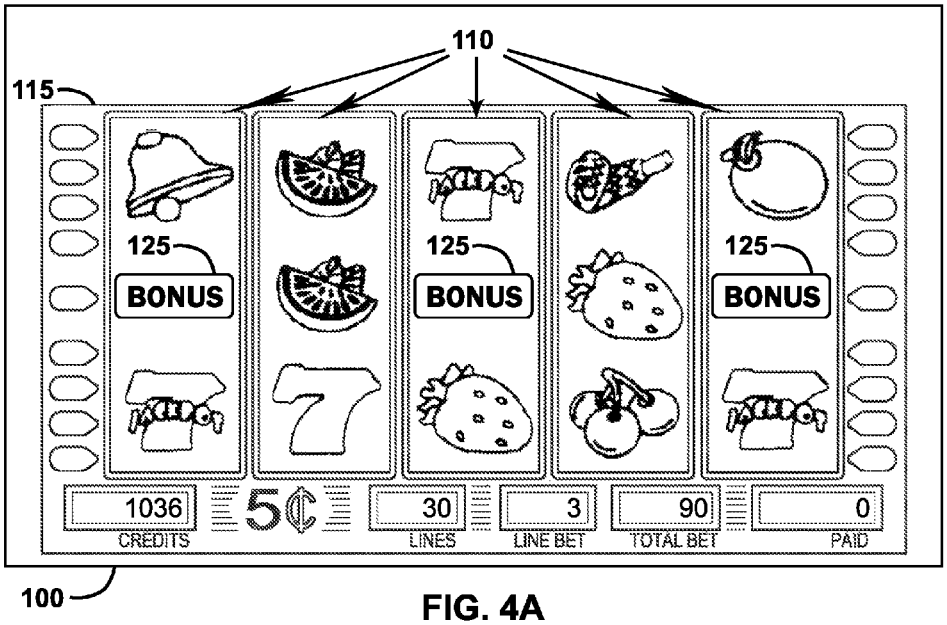
FIG. 4A
FIG. 4B
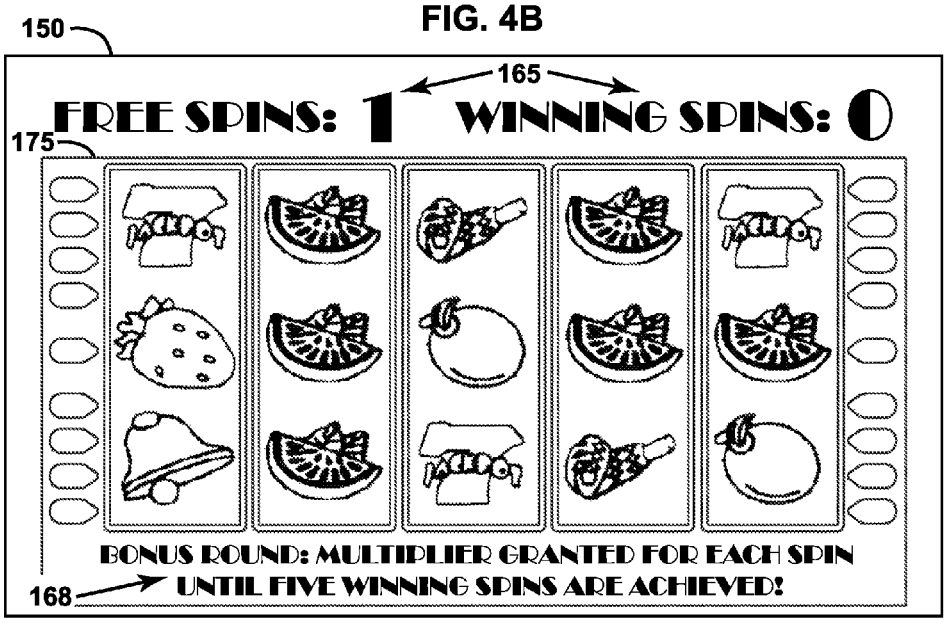

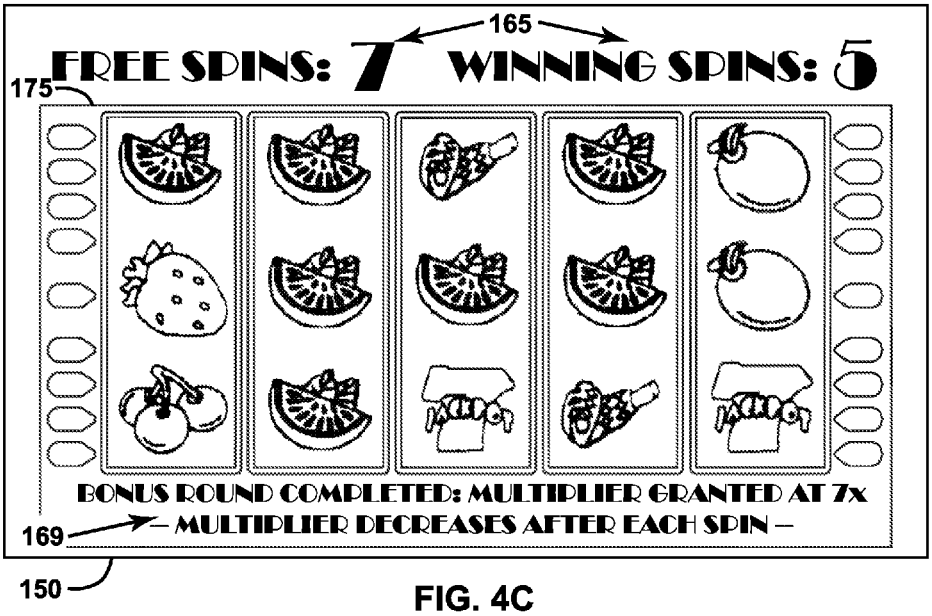
FIG. 4C
FIG. 4D
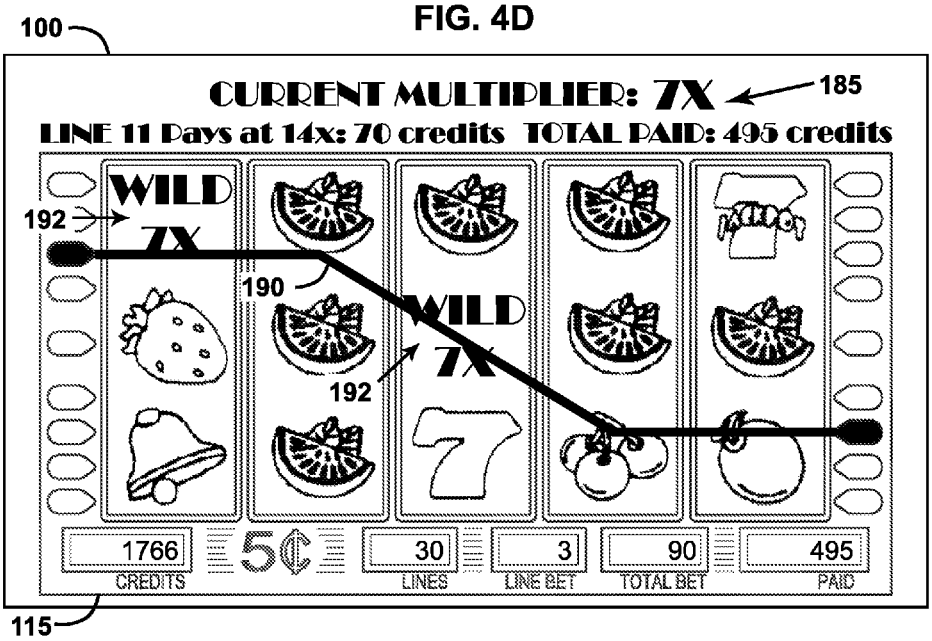

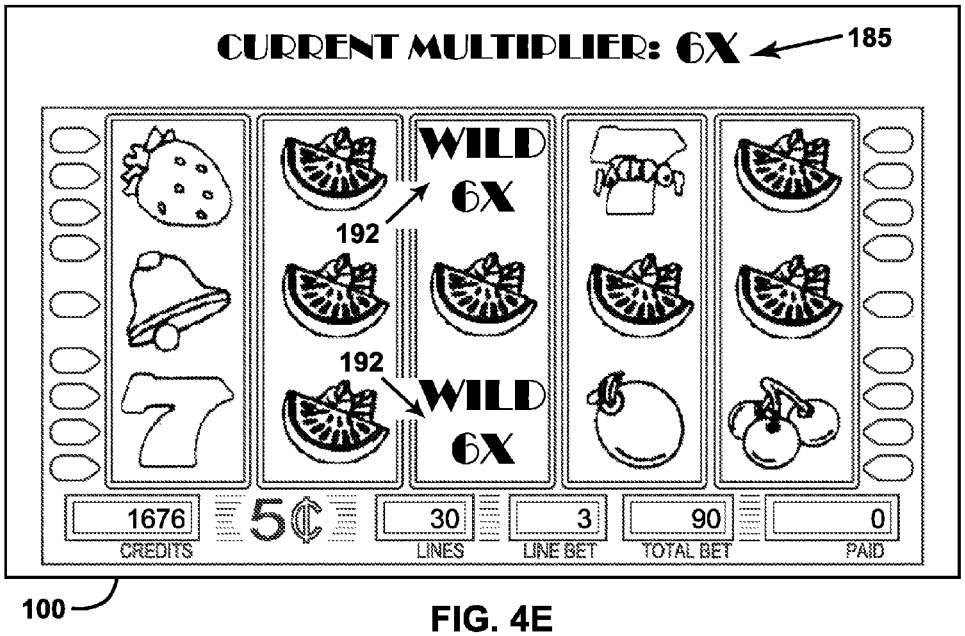
FIG. 4E
FIG. 4F
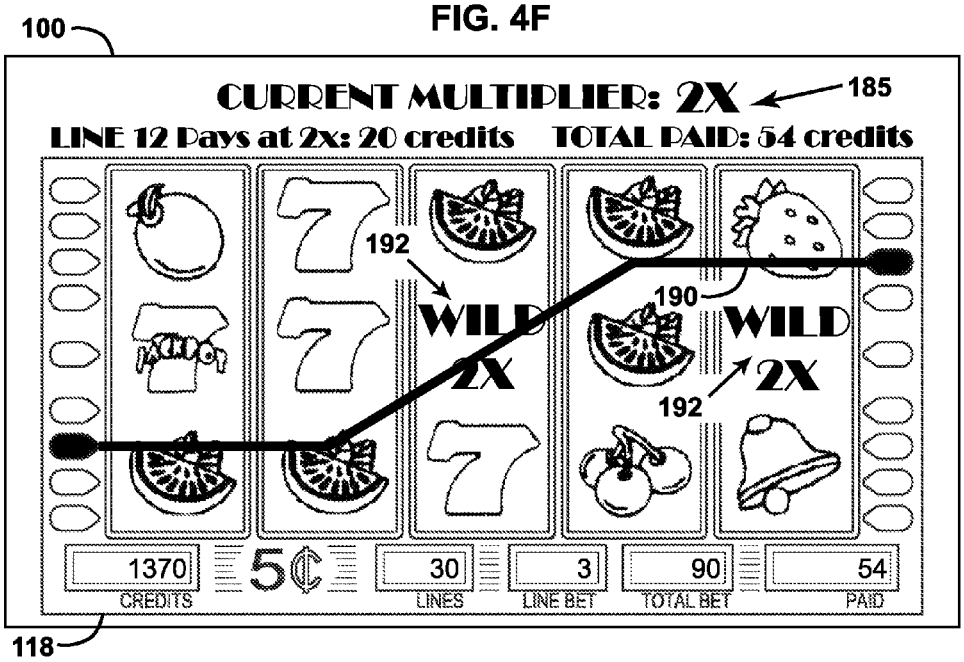

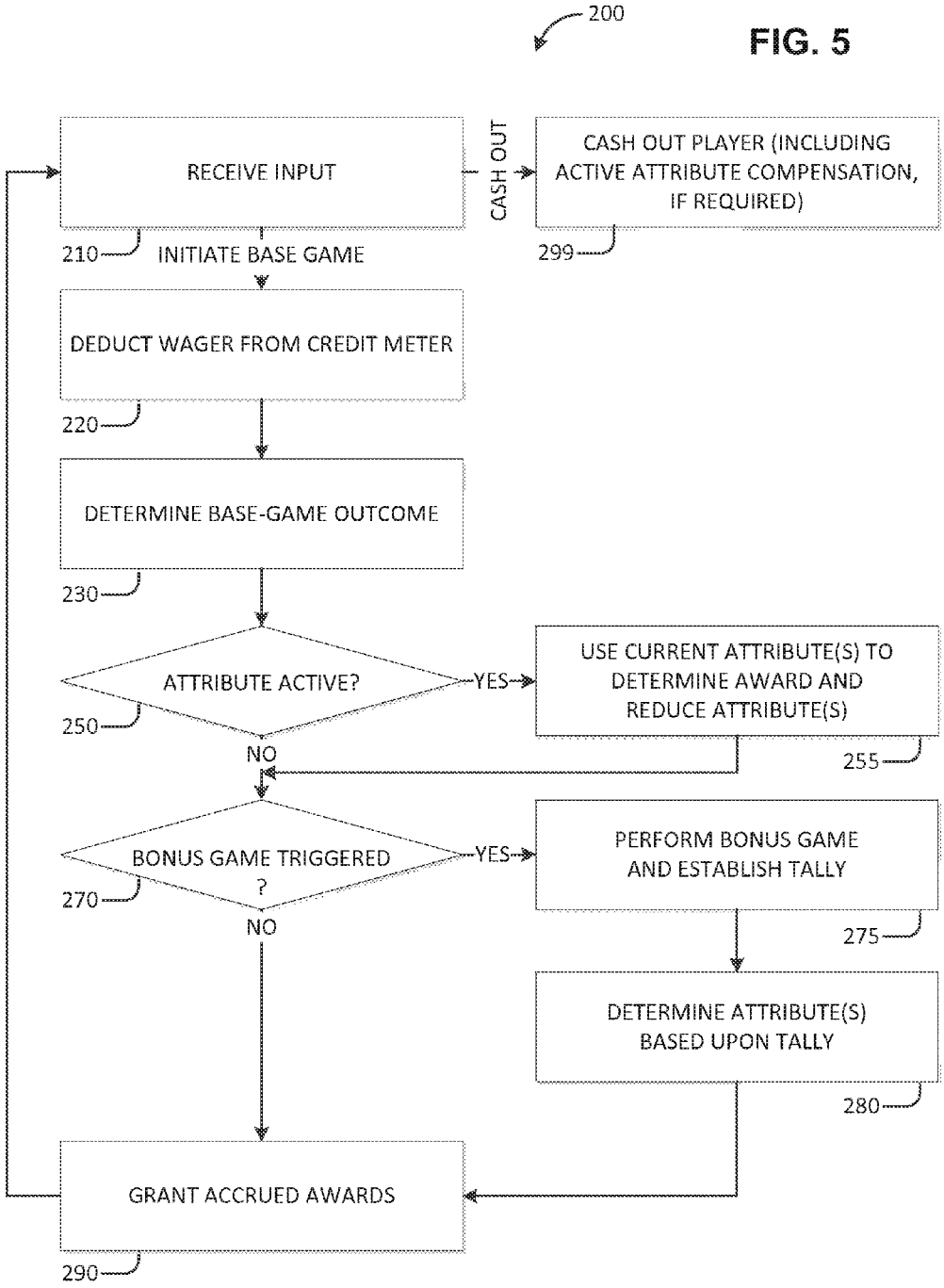
200
FIG. 5
RECEIVE INPUT
CASH OUT
CASH OUT PLAYER (INCLUDING ACTIVE ATTRIBUTE COMPENSATION, IF REQUIRED)
210
INITIATE BASE GAME
299
DEDUCT WAGER FROM CREDIT METER
220
DETERMINE BASE-GAME OUTCOME
230
ATTRIBUTE ACTIVE?
YES
USE CURRENT ATTRIBUTE(S) TO DETERMINE AWARD AND REDUCE ATTRIBUTE(S)
250
NO
255
BONUS GAME TRIGGERED ?
YES
PERFORM BONUS GAME AND ESTABLISH TALLY
270
NO
275
DETERMINE ATTRIBUTE(S) BASED UPON TALLY
280
GRANT ACCRUED AWARDS
290

GAMING MACHINE AND SYSTEM FOR REDEEMING AN ACCRUED ATTRIBUTE IN SUBSEQUENT GAMING INSTANCES

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to controlling a gaming system or gaming machine to accrue a tally of events or conditions in a wagering game instance and enable subsequent gaming instances to receive a beneficial effect based upon the tally that diminishes over time.

BACKGROUND OF THE INVENTION

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation. As the industry matures, the creativity and ingenuity required to improve such operation of gaming apparatus and games grows accordingly.

SUMMARY OF THE INVENTION

According to one aspect of the present invention, a gaming system comprises a regulated gaming machine primarily dedicated to playing at least one casino wagering game and game-logic circuitry for performing the casino wagering game. The gaming machine includes an electronic display device and one or more electronic input devices. The gaming system may be incorporated into a single, freestanding gaming machine. The electronic display device and the one or more electronic input devices are coupled to the game-logic circuitry. The one or more electronic input devices facilitate the game-logic circuitry to detect a physical item associated with a monetary value that establishes a credit balance. The one or more electronic input devices also facilitate the game-logic circuitry to receive a cashout input that initiates a payout from the credit balance. The credit balance changes based on play of the casino wagering game, and the wager is covered by the credit balance. The game-logic circuitry is configured to direct the electronic display device to display the casino wagering game and initiate a base-game instance of the casino wagering game in response to a wager input. The game-logic circuitry, in response to a triggering event occurring during the base-game instance, performs a bonus game by conducting one or more free plays and maintains a tally of a predetermined condition occurring during the one or more free plays. Subsequent to conducting the one or more free plays, the game-logic circuitry designates an attribute corresponding to a value of the tally. The game-logic circuitry also conducts a plurality of additional base-game instances in accordance with the attribute. Upon conclusion of each of the plurality of additional base-game instances, the attribute is reduced until the attribute is depleted According to another aspect of the invention, a computer-implemented method operating a gaming system primarily dedicated to playing at least one regulated casino wagering game is disclosed. The gaming system includes game-logic circuitry and a regulated gaming machine. The gaming machine includes an electronic display device, and one or more electronic input devices. The game-logic circuitry is configured to detect a physical item associated with a monetary value that establishes a credit balance. The game-logic circuitry is also configured to receive a cashout input that initiates a payout from the credit balance. The credit balance changes based on play of the casino wagering game. The method for operating a gaming system comprises the game-logic circuitry directing the electronic display device to display the casino wagering game. In response to receiving an input indicating a wager input, the game-logic circuitry initiates a base-game instance of the casino wagering game. In response to a triggering event occurring during the base-game instance, the game-logic circuitry performs a bonus game by conducting one or more free plays and maintains a tally of a predetermined condition occurring during the one or more free plays. Subsequent to conducting the one or more free plays, the game-logic circuitry designates an attribute corresponding to a value of the tally. The game-logic circuitry then conducts a plurality of additional base-game instances in accordance with the attribute. The attribute is reduced by the game-logic circuitry upon conclusion of each of the plurality of additional base-game instances until the multiplier is depleted.

According to one aspect of the present invention, a gaming system comprises a regulated gaming machine primarily dedicated to playing at least one casino wagering game and game-logic circuitry for performing the casino wagering game. The gaming machine includes an electronic display device and one or more electronic input devices. The gaming system may be incorporated into a single, freestanding gaming machine. The one or more electronic input devices are configured to facilitate the game-logic circuitry to detect a physical item associated with a monetary value that establishes a credit balance. The one or more electronic input devices also facilitate the game-logic circuitry to receive a cashout input that initiates a payout from the credit balance. The credit balance changes based on play of the casino wagering game. The game-logic circuitry is also configured to direct the electronic display device to display the casino wagering game. In response to a wager input indicative of a wager covered by the credit balance, the game-logic circuitry initiates a base-game instance of the casino wagering game. In response to a triggering event in the base-game instance, the game-logic circuitry initiates a bonus game by conducting a number of free plays until a predetermined number of winning bonus-game outcomes of the free plays have resulted. Subsequent to the bonus game, the game-logic circuitry conducts a plurality of additional base-game instances using an attribute corresponding to the number of conducted free plays. The attribute is associated with one or more symbols of the additional base-game instances. The game-logic circuitry reduces the attribute following each subsequent base-game instance until the attribute is depleted.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 4A is an image of an exemplary basic-game screen triggering a bonus game of a wagering game displayed on a gaming machine, according to an embodiment of the present invention.

FIG. 4B is an image of an exemplary bonus-game screen of a wagering game displayed on a gaming machine, according to an embodiment of the present invention.

FIG. 4C is an image of an exemplary bonus-game screen of a wagering game displayed on a gaming machine as the bonus game completes, according to an embodiment of the present invention.

FIG. 4D is an image of an exemplary basic-game screen performing a game instance subsequent to a recently completed bonus game displayed on a gaming machine, according to an embodiment of the present invention.

FIG. 4E is an image of an exemplary basic-game screen performing a game instance subsequent to the game instance of FIG. 4D displayed on a gaming machine, according to an embodiment of the present invention.

FIG. 4F is an image of an exemplary basic-game screen performing a game instance subsequent to the game instance of FIG. 4E displayed on a gaming machine, according to an embodiment of the present invention.

FIG. 5 is a flowchart for a data processing algorithm performed by game-logic circuitry that corresponds to instructions executed by a controller in accord with at least some aspects of the disclosed concepts.

Figure 1:
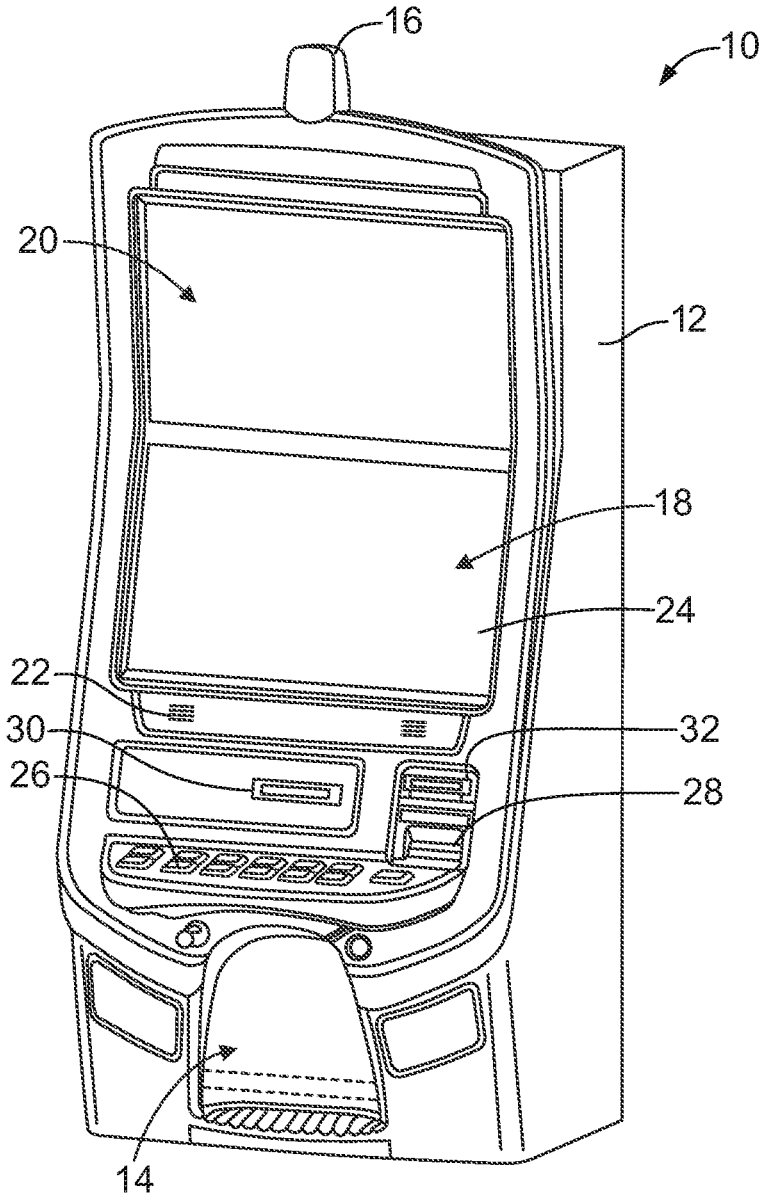
FIG. 1 is a perspective view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. No. 6,517,433, U.S. Pat. No. 8,057,303, and U.S. Pat. No. 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are reflected in a credit balance having a corresponding monetary value and are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer. When the gaming machine determines a winning outcome for the wagering game, the credit balance may be modified to reflect the payout for the winning outcome.

Thus, one or more input devices are configured to detect a physical item associated with a monetary value. The detection of the physical item establishes a credit balance that corresponds to a monetary value. The credit balance changes based on play of the casino wagering game, for example, decreasing when wagers are placed to initiate the wagering game and increased in response to winning outcome(s) of the wagering game. One or more input devices may receive a cashout input (e.g., from the player) that initiates a payout from the credit balance.

Figure 2:
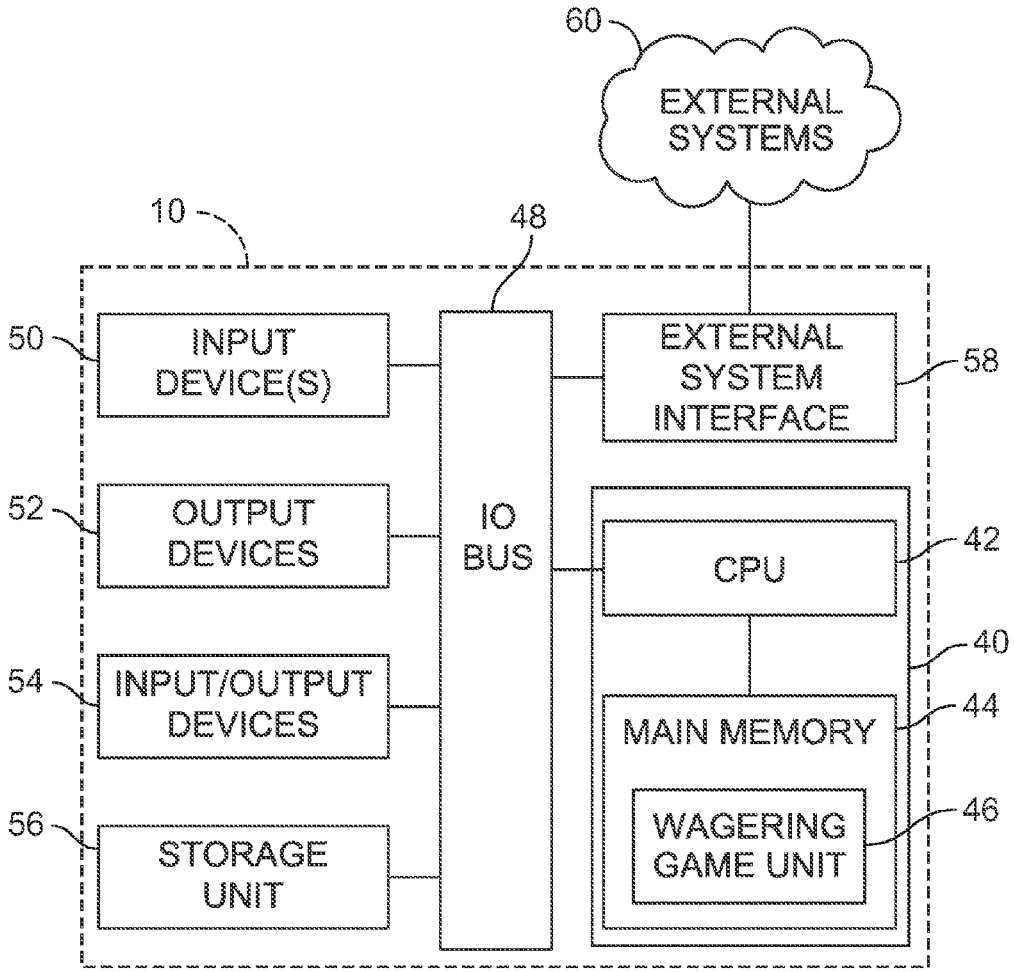
FIG. 2 is a schematic view of a gaming system according to an embodiment of the present invention.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compares it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

In response to an initiation of a wagering game, an instance of the wagering game is executed and performed until completion. When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
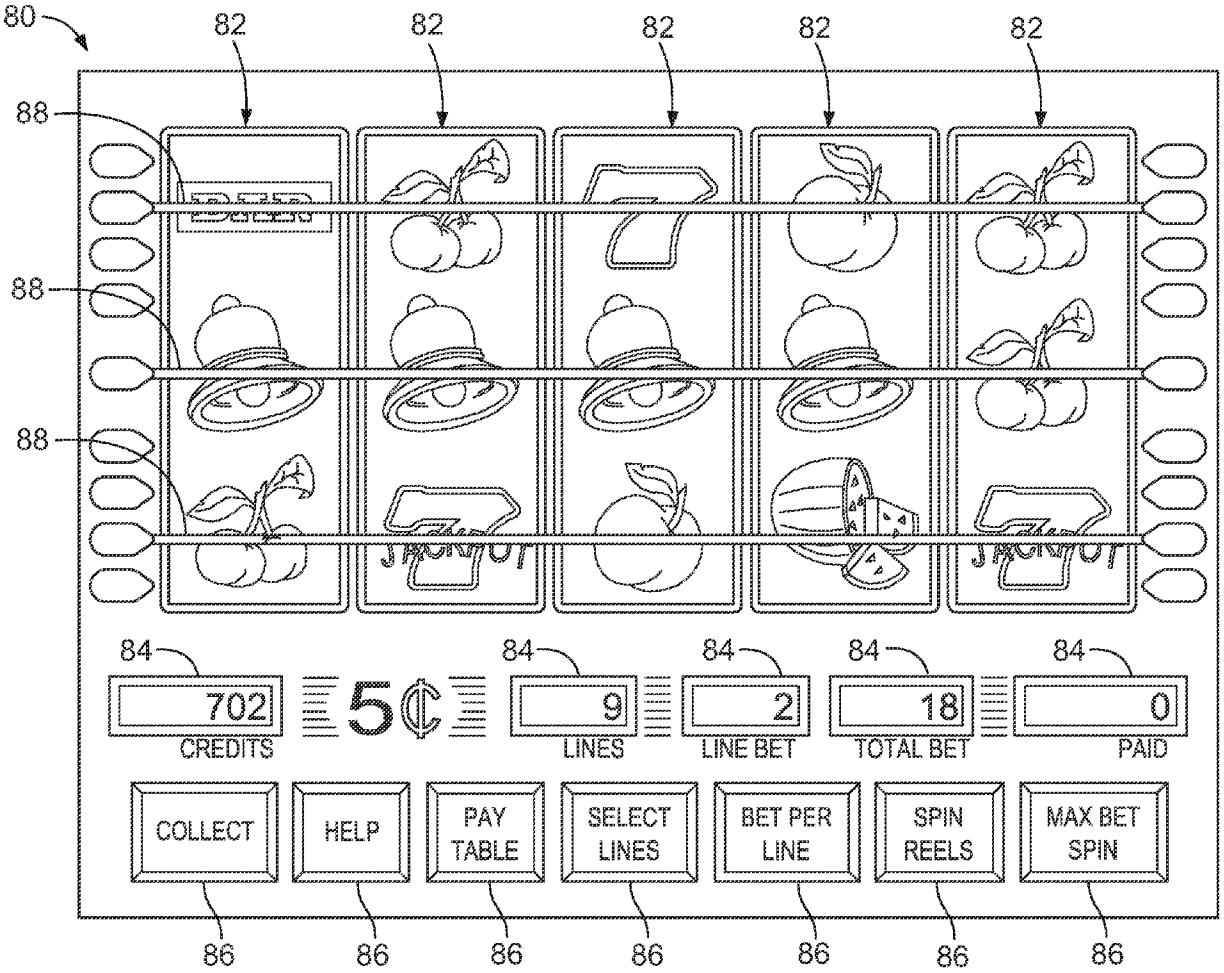
FIG. 3 is an image of an exemplary basic-game screen of a wagering game displayed on a gaming machine, according to an embodiment of the present invention.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager, a basic-game instance is initiated and the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager by providing a wager input, a wagering-game instance is initiated, and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Referring now to FIG. 4A, there is illustrated an image of a basic-game screen 100 adapted to be displayed on one or more of the output display devices (e.g., the primary display 18 or the secondary display 20) of a gaming machine (e.g., gaming machine 10) during a base-game instance in accordance with one embodiment. The screen 100 includes a set of symbol-bearing reels 110 (similar to simulated symbol-bearing reels 82) used to determine a randomized outcome 115 for the base wagering game. The outcome 115 includes special bonus-game triggering symbols 125 presented on the set of symbol-bearing reels 110. In this embodiment, the presence of three distinct bonus-game triggering symbols 125 indicate to the player that a bonus game will be initiated in response to this particular basic-game outcome. In other embodiments, a bonus game may be triggered by any one (or more) of a particular event or condition in the base game, for example, a single symbol, additional symbols, one or more symbols in a particular predetermined pattern, a random trigger not requiring a symbol, etc.

During the bonus game (sometimes called a bonus round), a tally of one or more particular events, occurrences, or conditions is tracked and may impact the operation of subsequent spins of the wagering game by use of a corresponding accrued attribute. The accrued attribute is derived from the value of the tally and corresponds to an effect, alteration, or gaming feature performed during future instances of the base game, bonus game, or both. The attribute may remain active (or "in use") for a limited duration, a limited number of spins, or until the attribute is replaced with a new, augmented, modified attribute, or is removed (e.g., by being diminished until depleted). In an embodiment, the attribute is a multiplier that decreases by one in response to completion of each subsequent spin of the base game (i.e., base-game instance).

For example, in one embodiment, an accrued attribute determines a number of symbols that are added to the reel strips of the one or more reels during the additional base-game instances. As base-game instances are completed, the number of added symbols diminishes until the reel strip of the one or more reels revert to the default reel strips used for the one or more reels. In another embodiment, a number of the lowest valued symbols of one or more reels may be removed, or alternately, be replaced with higher valued symbols as base-game instances occur while the attribute remains active.

In other embodiments, the one or more reels may be modified during the bonus game prior to the determination of an accrued attribute. For example, as a free spin generates a free spin outcome during the bonus game, one or more outcome symbols of one or more of the free play reels may be removed (or replaced) to modify the probabilistic chances of obtaining a winning outcome. Any accrued attributes that are active during the free plays of a bonus game may also be applied to the free spin outcomes of the bonus game.

The subsequent spins/plays/games/instances impacted by the attribute(s) as a result of one or more tally values may be part of a base game, a bonus game, an additional bonus game, or any/all of these. In an embodiment, while a bonus game is conducted, free spins are granted continuously until a total of five winning spin outcomes are achieved (e.g., a non-zero outcome payout or a payout above some minimum threshold). As the free spins are performed, the tally value tracks the number of free spins that are performed; the tally is incrementing each time a free spin is conducted. After the five winning free spin outcomes are achieved, the value of the tally is used to grant a corresponding value for an assigned multiplier (attribute) associated with one or more subsequent spins of reels in corresponding base-game instances. The multiplier increases (i.e., multiplies) rewards for winning symbol combinations, e.g., line pays or scatter pays, that include a predetermined symbol(s) associated with the multiplier. The multiplier diminishes over time, decrementing each time a base-game instance concludes.

Alternately, an attribute (e.g., a multiplier) may affect the outcome of all spins during base-game instances while the attribute remains active. For example, a multiplier attribute may be uniformly associated with all the paylines of subsequent spins, apply only to individual paylines (e.g., specific, determined, or dedicated, potentially based on one or more randomly generated numbers), rely upon the presence of one or more specific symbols in a payline, or any combination of these. In an embodiment, a specific WILD symbol of the reels is associated with the multiplier attribute during each of the spins of the subsequent instances. In this case, only line pays and scatter pays containing the WILD symbol(s) enabling a winning combination of symbols have adjusted awards derived from the present value of the multiplier attribute.

A tally may relate to and track any quantifiable parameter. That is, any measurable quantity may constitute contribution to the tally or accrued attribute. In an embodiment, the tally corresponds to the number of free spins of the bonus game that are conducted until five winning free spins outcomes are achieved. Thus, the minimum value for the tally upon completion of the free spins is five. In other embodiments, any variable parameter may be used to produce a corresponding tally, including but not limited to a number of total winning free spins, a number of total losing free spins, the presence of one or more special symbols in a free spin outcome (e.g., the number of WILD symbols visible when each free spin is completed), a number of non-triggering bonus symbols, a number of outcome total pay amounts over/under a predetermined value, the number of jackpots won, the number of winning/non-winning lines of each free spin outcome, the number of three, four, or five-of-a-kind paylines, the number of winning lines, etc.

Further, multiple tallies may be maintained and may be tracked concurrently. For example, in one embodiment, a number of non-winning spins may be tracked in a first accrued tally, and a number of spins performed are tracked in a second accrued tally. The two accrued tallies are then combined to generate a single multiplier attribute. Further, the two accrued tallies may not be combined and separately relate to simultaneous multiplier attributes that are concurrently active and/or associated with different symbols. Thus, a number of tally values, and the resultant number of corresponding attributes may vary greatly from embodiment to embodiment. When multiple tallies are being maintained, the attributes that result may be dependent upon the value of both the tallies. For example, if two tallies are separately tracked associated with a multiplier for differing, respective symbols, the multiplier attribute for each may be identically designated as the sum of the two tallies. Thus, the accruing of multiple tallies may impact or outright determine one or more attributes for future spin or game instances.

Each attribute may similarly impact any variable parameter of the subsequent wagering base-game instances, including one or more features of the spins performed during those instances. For example, various aspects of the gaming instance may be altered and impacted by a modular attribute based on the tally value. The attribute may also diverge from a one-to-one correspondence with the tally value. For example, while an embodiment includes use of a multiplier attribute corresponding to the accrued number (tally) of free spins performed during the bonus game, another embodiment may provide a multiplier attribute that is double (or triple, etc.) the tally value, is otherwise proportional, or alternatively, assigned a specific magnitude corresponding to a range of possible tally values upon completion. Further, the tally (and corresponding attribute) may be derived using an intermediate pseudo-value that may not be equivalent to the tally. For example, the tally may indicate a number of pairs of bonus-game winning outcomes, while a corresponding pseudo-value may keep track of the actual number of the entirety of winning outcomes of the bonus game. Further, one or more additional random numbers may further impact the operation of the specific attribute once a final tally has been accrued.

Further, the attribute may include modification of a reel strip that resides upon a corresponding base-game or bonus-game reel by adding, removing, or exchanging symbols on one or more reels. When a base-game or bonus-game generates outcomes using the symbols present on a plurality of reels, a default set of reels having a default set of reel strips are typically employed when generating such outcomes. An attribute may impact the symbols on the reel strips of the reels used to generate symbol outcome arrays For example, use of an attribute that adds specific symbols (e.g., high paying symbol streaks or WILD symbols) to one or more reels may occur. Alternatively, replacement of symbol(s) on the reel(s) (a modification of the corresponding reel strip), or a modification of the weighting of symbols on the reels may be used to alter the probabilistic math model used for game-outcome and random-symbol determinations during game outcome generation. The attribute may add additional BONUS symbols to trigger or retrigger additional effects or gaming features, introduce additional new symbols that are only available while the attribute is active, etc., and/or assign new functionality for one or more already present symbols.

An attribute may (additionally or alternatively) modify the reels, reel strips, base-game outcome symbol array, etc., for a specific duration of time or a particular number of subsequent base-game instances or spins. For example, the addition of rows or columns to a base-game instance outcome symbol array based on the attribute may occur for a specific amount of time. Thus, an attribute may cause adding a number of symbols (e.g., inserted between two existing symbols on a reel strip) corresponding to the attribute value to one or more reels of additional base-game instances (i.e., future game instances), replacing a number of symbols corresponding to the attribute on one or more reels of the additional base-game instances, removing of a number of symbols from one or more reels, removing of a number of symbols having the lowest relative value from one or more reels, replacing a number of symbols on one or more reels with one or more symbols having a higher relative value, replacing a number of one type of symbols on one or more reels with a differing symbol having the same relative value, addition or removal of one or more reels of the outcome array (e.g., inserting a reel into a 4×5 symbol outcome array to generate a 4×6 symbol outcome array), addition or removal of the number of symbols of each reel presented, etc.

The attribute may dictate use of a specific, modified math model for a predetermined number of spins, or provide additional game features or eligibility for specific prizes. For example, an active attribute may provide a replacement pay table having different symbol combinations, or an active attribute may provide a corresponding number of symbols on one or more reels that are not found on any reels of the wagering game when no attributes are active.

The attribute may further impact the transfer of symbols, reels, and/or symbol array outcomes to other symbol arrays that may be part of the wagering base-game instance, or alternatively, a separate wagering base-game instance. For example, in a wagering game utilizing Colossal Reels™ having multiple reel sets where symbols may transfer between the reels, the effect of the tally may impact the result of such operations during a single base-game instance or across multiple base-game instances. Alternately, in an environment having multiple concurrently performed wagering games, the effects of the tally may impact or modify the operations of one or more wagering games and wagering-game instances distinct from the wagering game determining the tally.

An embodiment binds a current multiplier attribute value to a set of WILD symbols present on the reels (in the subsequent base-game instances while the attribute is active) where the initial value of the multiplier attribute is based upon the tally. The multiplier attribute value decreases in response to the completion of each subsequent base-game instance spin. While the attribute is active, each payline of each outcome symbol array that utilizes one or more WILD symbols to make a winning combination will have the corresponding winning outcome award amount adjusted using the value of the multiplier attribute(s), dependent upon the number of WILD symbols in the line pay or scatter pay of the winning combination.

An accrued attribute may also trigger additional features based upon the value of the tally, including the modification of the math model of the wagering game (in a particular way) to impact various gaming features. Among these include modifying winning outcomes and results for a particular number of spins, awarding additional free spins, awarding additional free spins with modified reels, triggering an additional bonus game, awarding a monetary amount based on the tally value, etc. Further, the effect of the tally may increase or otherwise alter the actual or effective wager(s) placed in subsequent spins or gaming instances, for example, by doubling the effective wager amount for each payline or particular paylines or halving the amount of credits the player is required to deduct from the credit meter prior to the game instance being initiated. The attribute may remain active during multiple wagering-game instances or be confined to conclude in the same wagering-game instance.

A duration of the active attribute may be dependent upon a predetermined threshold of time or utilize a decrementing value of the attribute based on usage. For example, a corresponding multiplier attribute may diminish over time at a static rate during game play, or alternatively, decrease after every spin, every winning spin, or in response to some other condition or event (like a generated random number or appearing symbol). Other diminishing triggers may include decrementing the value of the attribute based on random determinations (to decrement and/or remain static), in response to one or more events of the subsequent spins or instances, based on a number of occurrences of an event or condition, every sixty seconds, etc.

For each diminishing (or reduction) of the accrued attribute, the amount that the attribute decreases may include any amount of diminution. For example, a multiplier attribute may be reduced by one, two, etc., at the conclusion of every spin. Another example includes symbol stacks on reel strips for one or more reels that shrink over time, a symbol array that shrinks over time, reduction in the number of WILD symbols on one or more reels, etc. In an embodiment, the multiplier attribute decrements each time an outcome is generated for one of the subsequent base-game instances (i.e., each time a subsequent wagering-game base-game spin is concluded and completed). Alternatively, the attribute may be active and applied to a single subsequent spin (or instance), and may be modified to compensate for the remaining duration of the attribute. For example, in response to the tally corresponding to activating a 10× multiplier attribute (perhaps by design or as a result of a player terminating the base game), the multiplier attribute may be applied to the outcome of a single subsequent spin or base-game instance at a 15× multiplier rather than diminishing over a longer period of time. Further, an attribute may relate to a particular (monetary) value that is accounted to a credit meter upon forfeiture.

Referring now to FIG. 4B, there is illustrated an image of a bonus-game screen 150 adapted to be displayed on one or more of the output display devices (e.g., the primary display 18 or the secondary display 20) of a gaming machine (e.g., gaming machine 10) in accordance with one embodiment. The bonus-game screen 150 includes a textual banner 165 that reports the number of free spins performed and the number of winning spins resulting from the performed free spins. Additional banners (e.g., banner 168) may also accompany the presentation. The bonus-game screen 150 may also be configured in a completely different way while not departing from the overall scope and spirit of the invention.

The bonus-game screen 150 displays a symbol-based bonus-game outcome 175 that is the result of the first spin of the bonus game. The tally is tabulated and incremented during the bonus game and reflected in banner 165. The free-spin symbol outcome 175 shown is not a winning spin; that is, the paylines of the symbol outcome 175 do not correspond to any winning combinations of symbols as specified in the pay table for the wagering game. While the pay table for the base game and the bonus game may be different, the pay tables for the base game and the bonus game are identical in this embodiment so that the player may instantly recognize whether a winning combination is present. In the event that the concluded free spin outcome 175 exhibits a payline having a winning combination of symbols, the banners 165, 168 may be suitably updated with details regarding the winning combination and the tally incrementing. Alternatively or additionally, the banners 165, 168 may report an amount of the consequential credit amount won, any additional game feature triggers (e.g., additional free spins), and/or a running total of the accrued tally, the subsequent effects of the tally, etc.

In an embodiment, the bonus round continues until a total of five outcomes 175 having winning symbol combinations are achieved; the accumulated tally corresponds to the total number of free spins actually performed until this occurs. Upon completion, the tally is converted into a corresponding accrued multiplier attribute that is applied to subsequent base-game instances (i.e., upcoming wagering base-game spins). The multiplier attribute diminishes each time a base-game instance (wagered spin) is completed until the multiplier attribute is depleted (returns to 1×). That is, at the end of the bonus round, the total number of free spins performed during the bonus round determines a multiplier attribute that is visually added to the WILD symbols on the reel strips of the symbol reels of the base game for spins in subsequent instances (while the attribute is active). In the event that another bonus round occurs while the multiplier attribute is still active (i.e., has not completely diminished; greater than 1×), the new bonus round tally (and resultant multiplier attribute) is added to the current multiplier attribute when the bonus game concludes. That is, triggering a second bonus game quickly, during an active attribute from a prior bonus game, will add the gained effect multiplier attribute value to the current multiplier attribute value. The new multiplier attribute operates in the same way it did before, but has an increased value while it remains active.

Referring now to FIG. 4C, there is illustrated an image of a bonus-game screen 150 as the bonus game is concluding, in accordance with one embodiment. The banner 165 displays conditions of the bonus game that include an indication that the bonus game is completed and an indication of the tally tabulation (value). In the present case, this includes the indication that five winning spins have been achieved and a total of seven free spins were granted during the bonus game. In other embodiments, an additional presentation may include a mapping from one or more accrued tally values into one or more attributes.

The banner 168 (FIG. 4B) is replaced with an updated banner 169 indicating that the bonus game is completed and reports the corresponding attribute(s) granted based upon the value of the one or more tallies. In the present case, a multiplier attribute is granted that corresponds to the number of free spins performed during the bonus game. The multiplier attribute applies to subsequent base-game instances and, after each subsequent base-game instance, the multiplier attribute decreases. The banner 169 may include additional information, be completely absent, or be accompanied by various presentations including explanatory text, video sequences, associated audio, etc., to detail the effects of the attribute(s) and results of the bonus round.

Referring now to FIG. 4D, an image of a basic-game screen 100 adapted to be displayed on one or more of the output display devices of a gaming machine is illustrated in accordance with one embodiment. The screen 100 shown is subsequent to completion of a bonus game and reflects an initiation of a subsequent wagering base-game instance. The basic-game screen 100 includes a randomized outcome 115 for a wagering base-game instance that is similar to FIG. 4A. A banner 185 is included, reporting the current state of the attribute (in this case, a multiplier value).

The banner 185 also includes a result for the outcome 115 reflecting the award for one specific highlighted payline 190. The banner 185 will alternate through all paylines having a winning combination of symbols in accordance with the pay table for the wagering game, and specify the corresponding amount of the award for each payline as presented. The banner 185 also reports the impact of the corresponding attribute on the award for the payline, if applicable. The outcome 115 includes a highlighted payline 190 that includes two distinct WILD symbols 192.

In an embodiment, the multiplier attribute is associated with the WILD symbols 192 that are already present on the reel strips of the base-game symbol reels. The outcome 115 includes an indication of the WILD symbols 192 in such a way to reflect this association (the WILD symbols have a 7× multiplier indicator displayed concurrently thereon). Since there are two WILD symbols 192 having associated multiplier attributes in payline 190, the multiplier attributes are combined (e.g., summed) prior to the adjustment (i.e., multiplication) of the award corresponding to the symbol combination presented in payline 190.

In an embodiment, plural multiplier attributes are additively joined to result in a multiplier attribute value for the corresponding payline(s). The payline 190, containing two distinct WILD symbols 192 (each having a corresponding 7× multiplier attribute) combine to result in a 14× multiplier for the payline 190. This is reported in the banner 195 to inform the player of the calculation and corresponding award. In other embodiments, the multiplier attributes may be joined multiplicatively (resulting in a 49× payline payout) or ignored in duplicity (resulting in a 7× payout for all paylines). Other embodiments, using different attributes are also possible, including incrementing the multiplier value for each WILD symbol 192 in the payline 190.

In an embodiment having plural attributes that are currently active, the impact of attributes on awards, paylines, or outcomes may stack (i.e., apply collectively) or combine in specific ways (e.g., with selective priorities and/or outright removal). During the presentation of the bonus game and the subsequent base-game instances that are impacted by the lingering attributes related to one or more tallies, the player may be alerted to how the base-game instances, spins, paylines, etc., are being manipulated in a variety of fashions. For example, textual, audio, and/or video presentation imagery or animation may occur that inform the player about the operation of the wagering base-game instances and the nature of the attribute(s) that impact the way the gaming instances are processed.

Referring now to FIG. 4E, an image of a basic-game screen 100 is illustrated in accordance with one embodiment. The screen 100 shown immediately follows the base-game instance illustrated in FIG. 4D. Again, the basic-game screen 100 includes a randomized outcome 115 for the new wagering base-game instance. The banner 185 reflects the reduced multiplier attribute value. The WILD symbols 192 are similarly reflective of the attribute change.

Referring now to FIG. 4F, an image of a basic-game screen 100 is illustrated in accordance with one embodiment. In one embodiment, once determined and active, a multiplier attribute (e.g., as shown in the banner 185 and the WILD symbols 192) decreases by one at the conclusion of each subsequent base-game instance until the attribute is depleted (i.e., the multiplier reaches 1×). The screen 100 shown reflects a randomized outcome 118 generated subsequent to outcome 115 of FIG. 4D, that is, after numerous base-game instances and corresponding reductions of the multiplier attribute have occurred. The outcome 118 shows the multiplier attribute just prior to being completely diminished (via the banner 185 and the WILD symbols 192); as this base-game outcome 118 is completed, the multiplier attribute diminishes altogether, reverting to the default single ("1×") payline multiplier. The banner 185 reflects the multiplier attribute value used to determine a base-game award for the base-game instance, and the amount of the award. The following subsequent base-game instance will be performed without a corresponding active attribute.

Referring now to FIG. 5, described by way of example above, a data processing algorithmic method 200 is shown corresponding to at least some instructions (stored and executed by the game-logic circuitry 40 in FIG. 2) to perform the above described functions associated with the disclosed concepts in one embodiment.

In step 201, the data processing method 200 is performed during the wagering game. This may be a result of a gaming machine 10 being powered-on, booted, and placed into an operational mode where players may wager credits reflected in a credit balance by initiating the gaming machine 10 to perform an instance of the wagering game.

In step 210, the wagering game machine 10 receives input from the player. Input from the player may be received from one or more input devices (e.g., input devices 50) coupled to the wagering game machine 10, for example, in response to a physical actuation of a switch or button to wager credits reflected in a credit balance. When a button is actuated, a corresponding electronic signal or message is generated that identifies the button pressed (and/or the intended function of the actuation). The electronic signal or message is interpreted by one or more processes (e.g., performed by game-logic circuitry 40) to respond accordingly to the player input.

The wagering game machine 10 may receive many different forms of player input that correspond to a particular desired function. The data processing method 200 includes two of these types of input. The first type of input specifies that the player wishes to wager funds from the credit balance and initiate a wagering base-game instance. Initiating a wagering game instance may occur as a result of a player pressing a "max bet" button, specifying a wager amount and pressing a "spin" button, or the like. The second type of input specifies the player wishes to "cash out" and terminate further interaction with the wagering game machine 10.

In step 299, in response to the player providing input corresponding to "cashing out", player interaction with the wagering game and wagering game machine 10 terminates. During this process, the credit balance that corresponds to the display of the credit meter 84 of the basic-game screen 80 user interface are attributed to the player, either by an electronic transfer of virtual credits to an account associated with a player via an intervening communication network and network entity (e.g., one or more external systems 60), the printing of a ticket indicating a number of credits that may be exchanged for a viable type of currency (e.g., via the ticket dispenser 32), in physical currency (bills and/or coins distributed from the machine 10), or in some other fashion. When a player "cashes out", it may be required (by jurisdictional regulation) to compensate the player for one or more of the attributes that are currently active (impacting the future outcome(s) of the game), if this is relevant. When this occurs, suitable player compensation occurs, generally accompanying the delivery of funds or credits from the credit meter 84. In other embodiments, a player account may be compensated with other types of virtual or actual currency (reflected in a credit balance) that are usable to exchange for goods, services, gaming opportunities, etc.

In step 220, in response to player input indicating initiation of the base game of the wagering game, an instance of a base-game instance is initiated by deducting a wager amount from a credit balance of a player credit meter (e.g., one or more meters 84) and presenting the base-game instance process. This deduction ensures that the initiation of the base-game instance can be covered the credit balance.

In step 230, the base-game instance outcome is determined. For example, base-game instance is conducted with any attributes that are currently active (i.e., attributes that are affecting the current base-game instance). The attributes may be a result from prior bonus game rounds (or potentially, other gaming events like random number generation). Active attributes may span (i.e., be active for) many base-game instances. As detailed prior, this may include attributes being active and impacting the play of base-game instances for a specific amount of time, or in response to the initiation of the base game where the attribute diminishes as each base-game instance concludes.

Following the base-game instance being initiated and performed using the active attribute, a base-game outcome is generated for the base-game instance, typically using one or more randomly generated numbers as detailed prior. In one embodiment, a plurality of symbol-bearing reels are used to generate an outcome having symbol combinations corresponding to entries in a pay table.

In step 250, a determination is made as to whether an attribute is currently active (i.e., affecting the current base-game instance). In response to an attribute being active, processing must be performed to determine whether conditions relating to the reduction of the attribute are appropriate at that point in time (or perhaps, as a result of the completion of the current base-game instance).

In step 255, an award for the newly completed base-game outcome is determined (and typically displayed); the base-game outcome award is calculated using the one or more active accrued attributes. For example, a "X5" multiplier attribute will increase a corresponding 30 credit award to 300 credits. Once the award for the base-game outcome is calculated, one or more accrued attributes may be suitably reduced if conditions are met that require modification of the attribute(s). In one embodiment, the multiplier attribute employed for adjusting awards of the base-game outcome is decremented by one. In other embodiments, one or more determinations may be made to modify the attribute in an appropriate fashion (e.g., re-adding a symbol, removing an added column, etc). Further, the determinations may include comparison of randomly generated numbers to weighted tables, award totals for paylines of the base-game outcome, measured or elapsed time periods, etc., to control and dictate the manipulation of the accrued attribute. The reduction of the attribute may cause the next (subsequent) instance of the base game to be identical to a standard base-game instance not having an active accrued attribute. That is, the attribute may diminish to the point where the next base-game outcome is not impacted by the attribute any further. Thus, in this case, the accrued attribute is considered no longer active.

It is also possible to have multiple attributes simultaneously active for a given base-game instance. For example, a multiplier attribute (as detailed prior) may be used to enhance paylines of the base-game outcomes containing specific symbols. Further, the symbol-bearing reels of the base game may be modified by another accrued attribute (corresponding to a separate tally counter) to include an increased number of those specific symbols. The number of simultaneous attributes that are concurrently active is not limited to any particular amount and may occur as a result of a single bonus round or random determination or plural bonus rounds or random determinations.

Further, the reduction of the one or more active attributes may occur independently, for example, after a bonus game instance concludes, if relevant. In one embodiment, a currently active attribute may apply to winning symbol combinations of the bonus game while another attribute spans subsequent multiple base-game instances. In another embodiment, the attributes continue to diminish during each spin of reels in the bonus game, and remaining attributes carry over to subsequent base-game instances. Each currently active attribute may be treated completely independent from any other attribute, or some relationship of dependence or interaction can be defined for some or all of the active attributes. In the event that there is a need or desire for a designer to delay the reduction of one or more attributes until after the bonus game concludes, this is easily envisioned as being within the spirit and scope of the invention.

In step 270, in response to determining the base-game outcome award and reducing the attribute(s) (if relevant), or if no attribute is currently active, the base-game outcome is analyzed to determine whether a bonus-game instance should occur (i.e., whether a bonus game has been triggered). In one embodiment, the bonus game is initiated in response to triggering symbols 125 being displayed as part of the base-game outcome on the basic-game screen 100.

In step 275, in response to a bonus-game instance being triggered, the bonus game is performed and one or more tallies are established. During the execution of the bonus game, game events or conditions may occur that relate to one or more accrued attributes and/or tally counters being maintained for the bonus game. This information may determine how the current active attribute or a newly-implemented active attribute will be implemented or modified for subsequent gaming events (e.g., base-game instances). Ultimately, the bonus-game outcome is determined (potentially over the course of many bonus game spins) and at least one tally of a specific event or condition is tabulated and determined from the outcome(s) of the bonus game.

In step 280, a corresponding accrued attribute is determined based upon the tally determined during the bonus-game instance. The accrued attribute becomes active for future events of the wagering game (e.g., for subsequent base-game outcome determinations) and remains active until depleted. As mentioned prior, the resulting attribute for subsequent base-game outcomes may be partially dependent upon the value of an accrued attribute that is already active (e.g., incrementing or modifying a prior attribute value). In an embodiment, in response to a second bonus round occurring while another attribute is currently active, the two attributes are combined into a single attribute (i.e., a single, summed multiplier attribute). In other embodiments, the two attributes simultaneously exist being separately independent and diminish by reduction at arbitrary rates (either the same or different) in accordance with the design of the wagering game.

In step 290, after the bonus-game instance completes (or alternatively, if no bonus game is triggered), the base-game instance completes by granting any accrued awards to the player's credit meter. Accrued awards include base-game outcome awards and bonus-game outcome awards. For instance, a base-game outcome award may result from a combination of symbols recited in the pay table of the wagering game.

Further, a bonus-game award may be accounted to the player's credit meter if such an award is a result of the tally. In one embodiment, a monetary award may be granted to a player that corresponds to the tally value of a specific symbol as part of the bonus game. For example, an exponential or tiered award amount is granted for every pair of losing spins that occur during the bonus game. The attribute may include an award amount in addition to an attribute that spans multiple base-game instances. All direct monetary (or other currency) awards as a result of the bonus-game instance is accredited to the player during this final phase of the bonus game, potentially via a credit meter (e.g., meter 84).

Once the base-game instance completes, the process flow returns to step 210 where input from the player is received to perform additional processes, for example, initiating another base-game instance, modifying the wager levels, cashing out, etc.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming system, comprising:

a regulated gaming machine primarily dedicated to playing at least one casino wagering game, the gaming machine including an electronic display device and one or more electronic input devices; and game-logic circuitry configured to:

detect, via at least one of the one or more electronic input devices, a physical item associated with a monetary value that establishes a credit balance;

direct the electronic display device to display the casino wagering game, initiate a base-game instance of the casino wagering game in response to an input indicative of a wager covered by the credit balance, in response to a triggering event occurring during the base-game instance, perform a bonus game by conducting one or more free plays and maintaining a tally of a predetermined condition occurring during the one or more free plays, subsequent to conducting the one or more free plays, designate an attribute corresponding to a value of the tally, conduct a plurality of additional base-game instances in accordance with the attribute, reduce the attribute upon conclusion of each of the plurality of additional base-game instances until the attribute is depleted; and receive, via at least one of the one or more electronic input devices, a cashout input that initiates a payout from the credit balance.

2. The gaming system of claim 1, wherein the attribute is an award multiplier adjusting an award for a symbol-based outcome of an additional base-game instance.

3. The gaming system of claim 2, wherein the award multiplier is associated with one or more predetermined symbols.

4. The gaming system of claim 3, wherein, in response to a winning combination of symbols that includes a plurality of the one or more predetermined symbols, adjusting a corresponding award using a sum of the award multipliers of the one or more predetermined symbols.

5. The gaming system of claim 1, wherein the one or more free plays are conducted until a predetermined number of winning free play outcomes are achieved, and the predetermined condition includes an occurrence of each free play.

6. The gaming system of claim 5, wherein one or more outcome symbols of one or more free play reels used to generate the free play outcomes are removed at the conclusion of each free play to increase the probabilistic chances of obtaining subsequent winning free play outcomes.

7. The gaming system of claim 1, wherein the attribute corresponds to a number of symbols that are added to one or more reels during the additional base-game instances.

8. The gaming system of claim 1, wherein conducting the plurality of additional base-game instances in accordance with the attribute includes one of adding a number of symbols corresponding to the attribute to one or more reels of the additional base-game instances, replacing a number of symbols corresponding to the attribute on one or more reels of the additional base-game instances, removing a number of symbols corresponding to the attribute from one or more reels of the additional base-game instances, removing a number of symbols corresponding to the attribute having the lowest relative value from one or more reels of the additional base-game instances, and replacing a number of symbols corresponding to the attribute on one or more reels of the additional base-game instances with a symbol having a higher relative value.

9. A method of operating a gaming system, the gaming system including game-logic circuitry and a regulated gaming machine, the gaming machine primarily dedicated to playing at least one casino wagering game that includes a base game and a bonus game, the gaming machine including an electronic display device and one or more electronic input devices, the method comprising:

detecting, by the game-logic circuitry, a physical item associated with a monetary value that establishes a credit balance via at least one of the one or more electronic input devices;

directing, by the game-logic circuitry, the electronic display device to display the casino wagering game;

responsive to an input indicative of a wager covered by the credit balance, initiating, by the game-logic circuitry, a base-game instance of the casino wagering game;

in response to a triggering event occurring during the base-game instance, performing, by the game-logic circuitry, the bonus game including conducting one or more free plays and maintaining a tally of a predetermined condition occurring during the one or more free plays;

subsequent to conducting the one or more free plays, designating, by the game-logic circuitry, an attribute of the base game corresponding to a value of the tally;

conducting, by the game-logic circuitry, a plurality of additional base-game instances in accordance with the attribute, reducing, by the game-logic circuitry, the attribute upon conclusion of each of the plurality of additional base-game instances until the attribute is depleted; and receiving, by the game-logic circuitry, via at least one of the one or more electronic input devices, a cashout input that initiates a payout from the credit balance.

10. The method of claim 9, wherein the attribute is an award multiplier adjusting an award for a symbol-based outcome of the additional base-game instances.

11. The method of claim 10, wherein the award multiplier is associated with one or more predetermined symbols.

12. The method of claim 11, wherein in response to a winning combination of symbols that includes a plurality of the one or more predetermined symbols, adjusting a corresponding award using a sum of the award multipliers of the one or more predetermined symbols.

13. The method of claim 9, wherein the one or more free plays are conducted until a predetermined number of winning free play outcomes are achieved, and the predetermined condition includes an occurrence of each free play.

14. The method of claim 13, wherein one or more outcome symbols of one or more free play reels used to generate the free play outcomes are removed at the conclusion of each free play, by the game-logic circuitry, to increase the probabilistic chances of obtaining subsequent winning free play outcomes.

15. The method of claim 9, wherein the attribute corresponds to a number of symbols that are added to one or more reels during the additional base-game instances.

16. The method of claim 9, wherein conducting, by the game-logic circuitry, the plurality of additional base-game instances in accordance with the attribute includes one of adding a number of symbols corresponding to the attribute to one or more reels of the additional base-game instances, replacing a number of symbols corresponding to the attribute on one or more reels of the additional base-game instances, removing a number of symbols corresponding to the attribute from one or more reels of the additional base-game instances, removing a number of symbols corresponding to the attribute having the lowest relative value from one or more reels of the additional base-game instances, and replacing a number of symbols corresponding to the attribute on one or more reels of the additional base-game instances with a symbol having a higher relative value.

17. A gaming system, comprising:

a regulated gaming machine primarily dedicated to playing at least one casino wagering game that includes a base game and a bonus game, the gaming machine including an electronic display device and one or more electronic input devices; and game-logic circuitry configured to:

detect, via at least one of the one or more electronic input devices, a physical item associated with a monetary value that establishes a credit balance;

direct the electronic display device to display the casino wagering game, initiate a base-game instance of the casino wagering game in response to an input indicative of a wager covered by the credit balance, in response to a triggering event in the base-game instance, initiate the bonus game including conducting a number of free plays until a predetermined number of winning bonus-game outcomes of the free plays have resulted, subsequent to the bonus game, conduct a plurality of additional base-game instances using an attribute corresponding to the number of conducted free plays, the attribute being associated with one or more symbols of the additional base-game instances, reduce the attribute following each subsequent base-game instance until the attribute is depleted; and receive, via at least one of the one or more electronic input devices, a cashout input that initiates a payout from the credit balance.

18. The gaming system of claim 17, wherein the attribute is an award multiplier and winning outcome awards that include the one or more symbols are correspondingly adjusted by the award multiplier during the additional base-game instances.

19. The gaming system of claim 18, wherein in response to a winning combination of symbols that includes a plurality of the one or more predetermined symbols during the additional base-game instances, adjusting a corresponding award using a sum of the award multipliers of the one or more predetermined symbols.

20. The gaming system of claim 17, wherein a free play outcome symbol of one or more free-play reels used to generate the bonus game outcomes is removed at the conclusion of each free play to increase the probabilistic chances of obtaining subsequent winning bonus game outcomes.

* * * * *